US007735194B2

(12) United States Patent
Bruzek

(10) Patent No.: US 7,735,194 B2
(45) Date of Patent: Jun. 15, 2010

(54) CASEMENT WINDOW HINGE WITH SASH LOCATOR

(75) Inventor: Daniel Bruzek, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 891 days.

(21) Appl. No.: 11/429,403

(22) Filed: May 5, 2006

(65) Prior Publication Data

US 2006/0254028 A1 Nov. 16, 2006

Related U.S. Application Data

(60) Provisional application No. 60/678,771, filed on May 6, 2005.

(51) Int. Cl.
*E05D 7/04* (2006.01)

(52) U.S. Cl. ..... 16/242; 16/362; 49/252

(58) Field of Classification Search ..... 16/242, 16/362, 235, 254, 363, 364, 371, 368; 49/252
See application file for complete search history.

(56) References Cited

U.S. PATENT DOCUMENTS 1,211,733 A 1/1917 McQueen
1,705,830 A 3/1929 Stewart
1,706,830 A 3/1929 Upson
1,711,927 A 5/1929 Donovan
1,959,514 A 5/1934 Zimmer
2,094,990 A 10/1937 Lang
2,383,395 A 8/1945 Kuyper
3,797,169 A 3/1974 Armstrong
4,726,092 A 2/1988 Tacheny et al.
4,980,947 A * 1/1991 McQuigge ..... 16/235
5,040,267 A 8/1991 Dallmann
5,152,102 A 10/1992 La See
5,491,930 A 2/1996 La See
RE35,635 E 10/1997 Bauman
6,112,371 A 9/2000 Tremblay
6,134,751 A 10/2000 Carrier et al.
6,138,325 A * 10/2000 Figliola et al. ..... 16/382
6,643,896 B2 11/2003 Carrier
2004/0055113 A1 3/2004 Tremblay et al.

* cited by examiner

*Primary Examiner*—William L. Miller
(74) *Attorney, Agent, or Firm*—Patterson Thuente Christensen Pedersen, P.A.

(57) ABSTRACT

A sash locator for locating a casement window sash relative to a sash arm, includes an abutment structure disposed at a selected disposition relative to the sash arm such that positioning the sash proximate the sash arm with a selected portion of the sash abutting the abutment structure disposes the sash relative to the sash arm in a desired disposition for affixing the sash to the sash arm. A method of sash location relative to a sash arm is also included.

9 Claims, 7 Drawing Sheets

CASEMENT WINDOW HINGE WITH SASH LOCATOR

RELATED APPLICATION

The present application claims the benefit of U.S. Provisional Application Ser. No. 60/678,771 filed May 6, 2005, which is incorporated herein in its entirety by reference.

FIELD OF THE INVENTION

The invention relates generally to casement windows and more specifically to casement window hinges and methods for locating a window sash thereon.

BACKGROUND OF THE INVENTION

A casement window generally includes a frame portion, which is mounted in a rough opening provided in a structure, and an operable sash portion mounted in the frame with one or more hinges. A typical casement window hinge includes a track portion, which attaches to the window frame, and a sash arm, which attaches to the window sash. One end of the sash arm is pivotally attached to a shoe that is slidable on the track. A link arm is pivotally attached to each of the track and the sash arm. In operation, as the sash swings from the closed position to the open position, the sliding shoe slides along the track so that the inward side of the sash moves away from the corresponding side of the frame. Various prior casement window hinges are described and depicted in U.S. Pat. Nos. 1,706,830; 1,711,927; 2,094,990; 2,383,395; 3,797,169; 4,726,092; 5,040,267; 5,152,102; 5,491,930; 6,112,371; 6,134,751; and 6,643,896, all of which are hereby fully incorporated herein by reference.

A small degree of misalignment of the sash in the window frame may cause leaks and interference between the sash and frame during operation of the window. Consequently, a relatively high degree of accuracy and precision is required during window manufacture to ensure proper positioning and attachment of the sash arm to the sash. Fastener holes are generally pre-drilled in the sash using a jig in order to achieve the desired accuracy, thereby adding steps and attendant manufacturing costs. What is needed in the industry is a casement window hinge that is repeatably accurately attachable to a sash without pre-drilling or attachment jigs.

SUMMARY OF THE INVENTION

The present invention is a casement window hinge and attachment method that meets the need of the industry by providing a sash arm that is repeatably accurately attachable to the sash without pre-drilling of fastener holes and without an attachment jig. In an embodiment of the casement window hinge of the invention, a projection is provided on the sash arm at a point where the corner of the sash is desirably positioned. During assembly of the casement window, the corner of the sash may be simply butted against the projection with the sash arm properly aligned along the top or bottom of the sash. Self-drilling fasteners may then be used to attach the sash arm to the sash.

In an embodiment of the invention, the projection may be positioned at the pivotal attachment of the sash arm with the sliding shoe, and may be an extension of the pivot pin or rivet. In alternative embodiments, the projection may include an additional component attached to the pivot, a tab on the sash arm or sliding shoe, or a separate component attached to the sash arm. Differently sized projections may be used to accommodate variations in sash positioning needed for various window designs. Further, shaped concentric or eccentric projection heads may be used to enable selectively adjustable positioning of the sash arm on the sash.

The present invention is a sash locator for locating a casement window sash relative to a sash arm, and includes abutment means disposed at a selected disposition relative to the sash arm such that positioning the sash proximate the sash arm with a selected portion of the sash abutting the abutment means disposes the sash relative to the sash arm in a desired disposition for affixing the sash to the sash arm. The present invention is further a method of sash location relative to a sash arm.

DETAILED DESCRIPTION OF THE PREFERRED EMBODIMENTS

Figure 1:
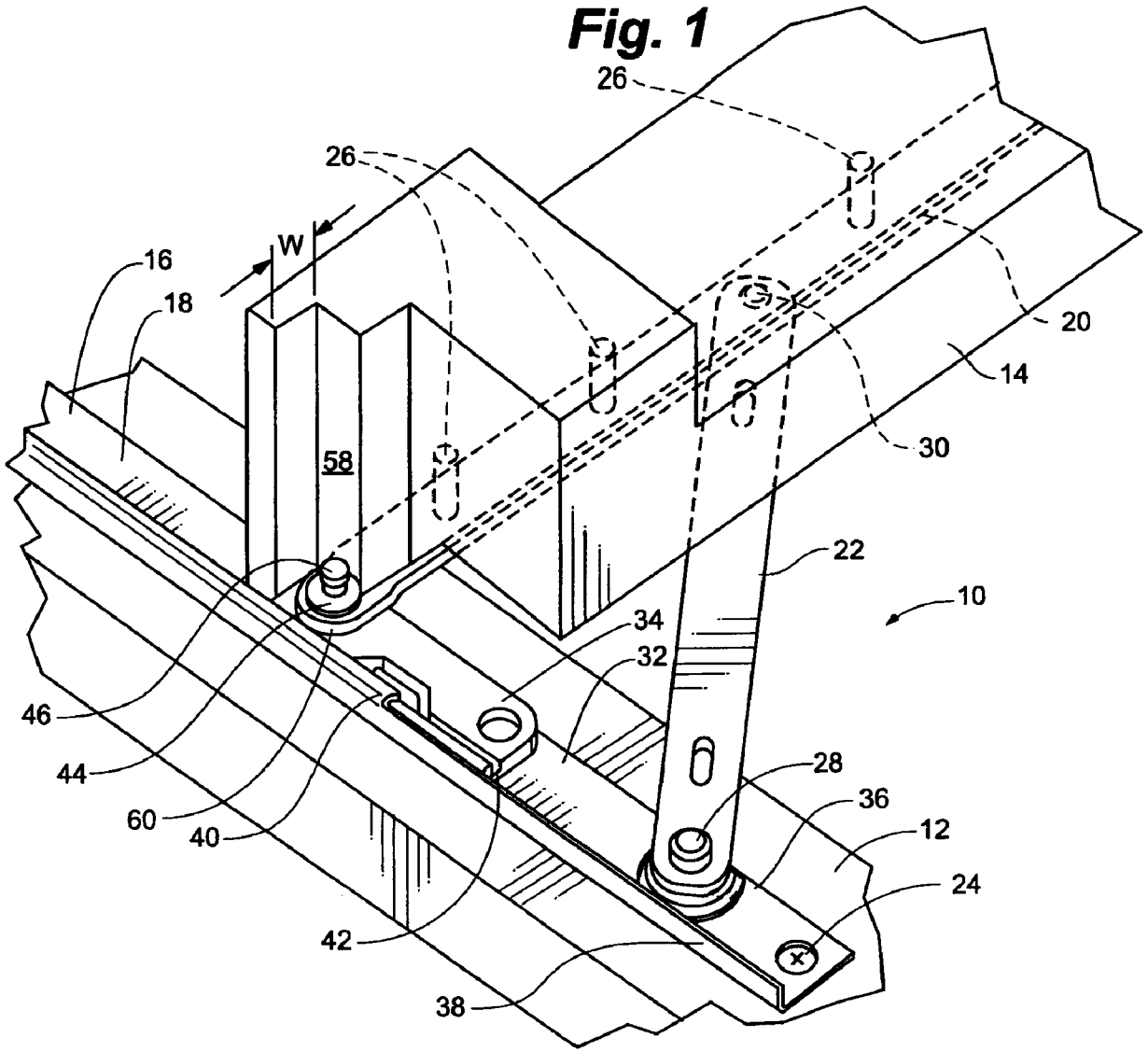
FIG. 1 is a partial perspective view of a casement window with a hinge according to the present invention in a sash open position.
Figure 2:
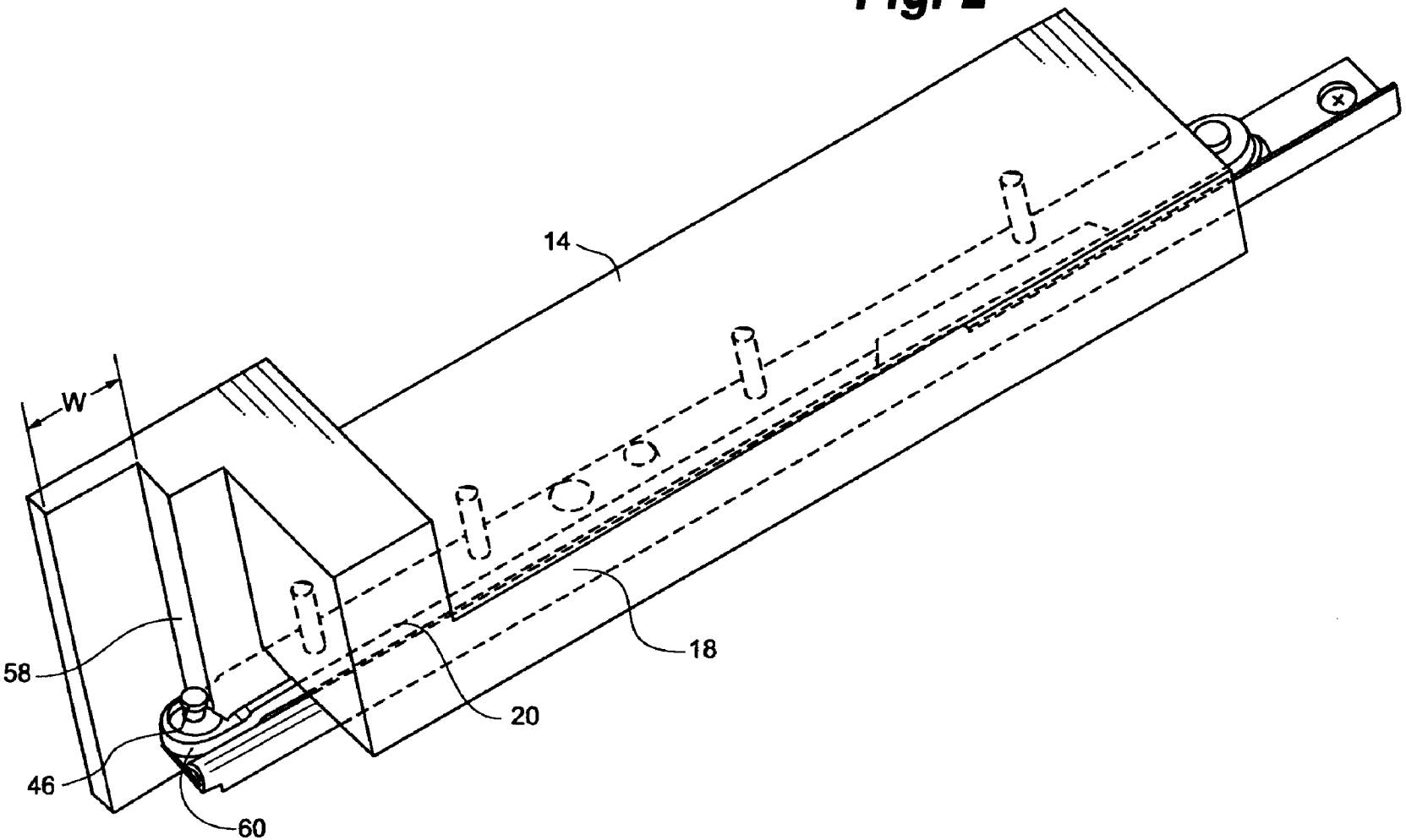
FIG. 2 is a partial perspective view of the casement window and hinge of FIG. 1 in a sash closed position.

A casement window and hinge 10 according to the present invention as depicted in FIG. 1 generally includes window frame 12, sash 14, and hinge 16. Hinge 16 generally includes track assembly 18, sash arm 20, and link arm 22. Track assembly 18 is fixed in position on frame 12 with one or more fasteners 24, and sash arm 20 is fixed in position on sash 14 with fasteners 26. Link arm 22 is pivotally attached to track assembly 18 and sash arm 20 at pivots 28, 30, respectively.

Track assembly 18 generally includes rail 32 and shoe 34. Rail 32 has planar portion 36 which secures to frame 12, and a flange portion 38 which is generally perpendicular to planar portion 36. Flange portion 38 has downturned lip 40 which slidably engages in groove 42 defined in shoe 34. Shoe 34 is selectively laterally slidable on rail 32 and is retained thereon by the engagement of lip 40 in groove 42. Sash arm 20 is pivotally attached to shoe 34 at pivot 44.

Figure 3:
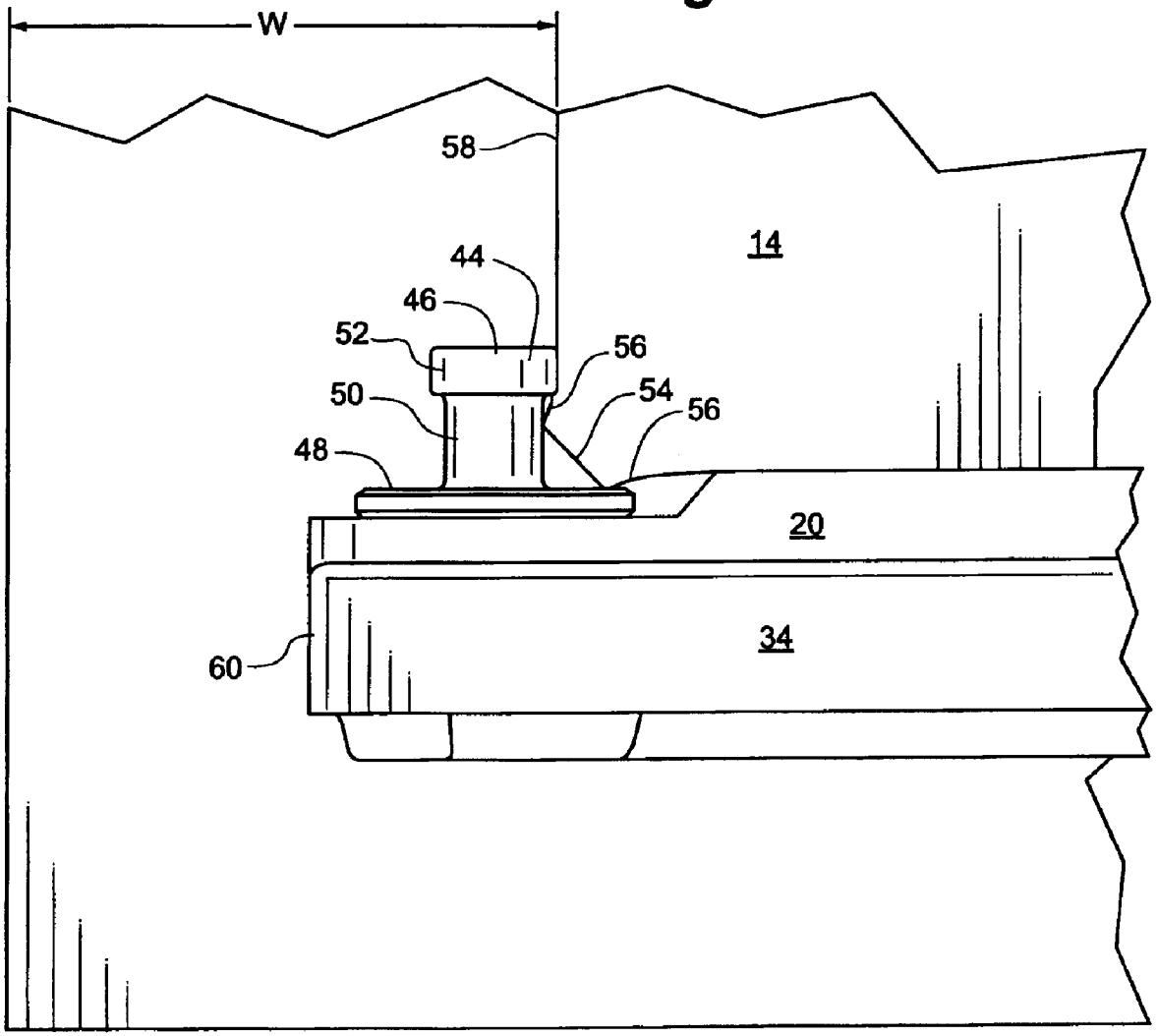
FIG. 3 is an enlarged elevation view of an embodiment of a sash locator according to the present invention.
Figure 4:
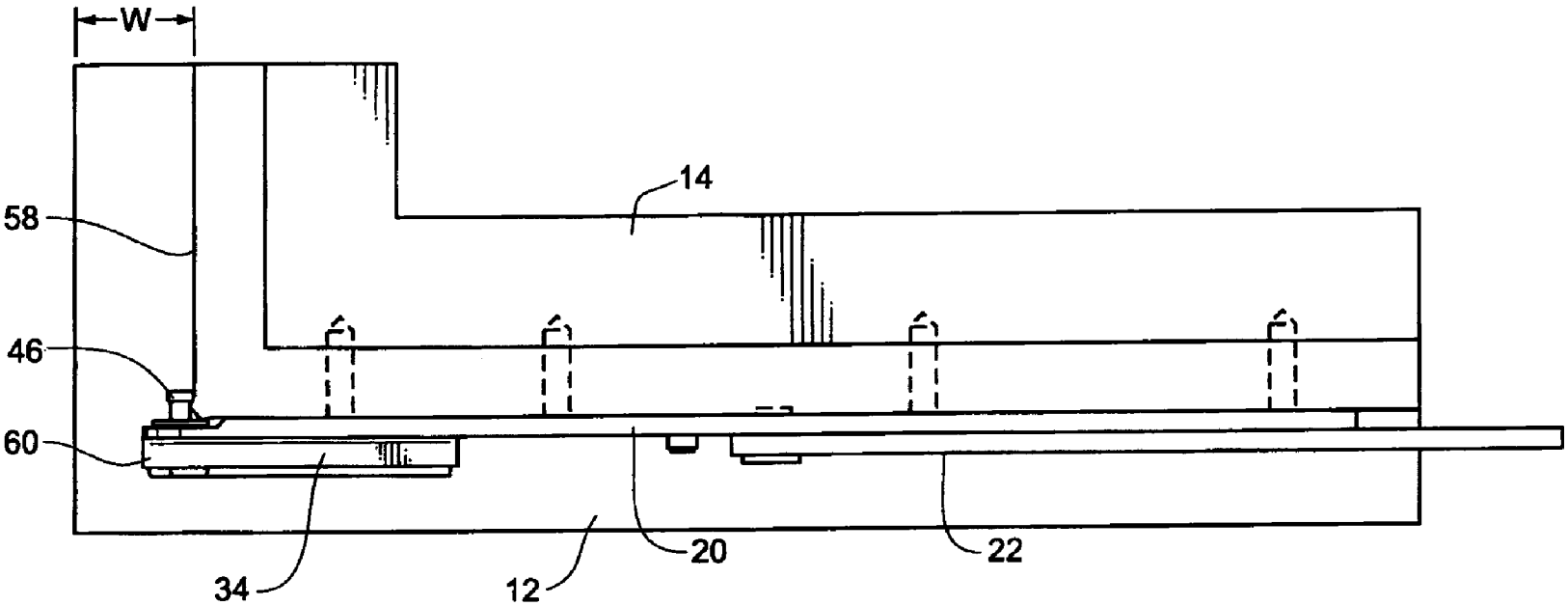
FIG. 4 is an elevation view of the casement window and hinge of FIGS. 1 and 2.

In an embodiment of the invention, pivot 44 includes a projecting sash locating post 46. As depicted in FIG. 3, post 46 includes a base 48, a barrel portion 50 and an enlarged head portion 52. The diameter of barrel 50 and head 52 is selected so that when sash 14 is butted tightly against post 46, sash arm 20 is correctly positioned on sash 14. Sash arm 20 may then be secured in position using self-drilling fasteners, thereby eliminating any need for pre-drilling of fastener holes in sash 14.

In the embodiment of FIG. 3, corner 54 of sash 14 is squared off and flares 56 are provided to engage with base 48 and under head 52. This arrangement may enable faster and more accurate vertical alignment of the sash when sash 14 is butted against post 46 when being fastened.

It will be appreciated that the diameter of barrel 50 and head 52 will have an effect on the relative position of sash arm 20 along sash 14. A larger diameter dimension may be selected if it is desired that the inward side 58 of sash 14 be spaced relatively further away from proximal end 60 of sash arm 20. This may be desirable, for example, to accommodate a sash having a relatively larger outer flange dimension W as depicted in FIG. 1. Likewise, a smaller diameter dimension will cause inward side 58 to be spaced relatively closer to proximal end 60, as may be needed, for example, in sashes having a relatively smaller outer flange dimension W.

Figure 5:
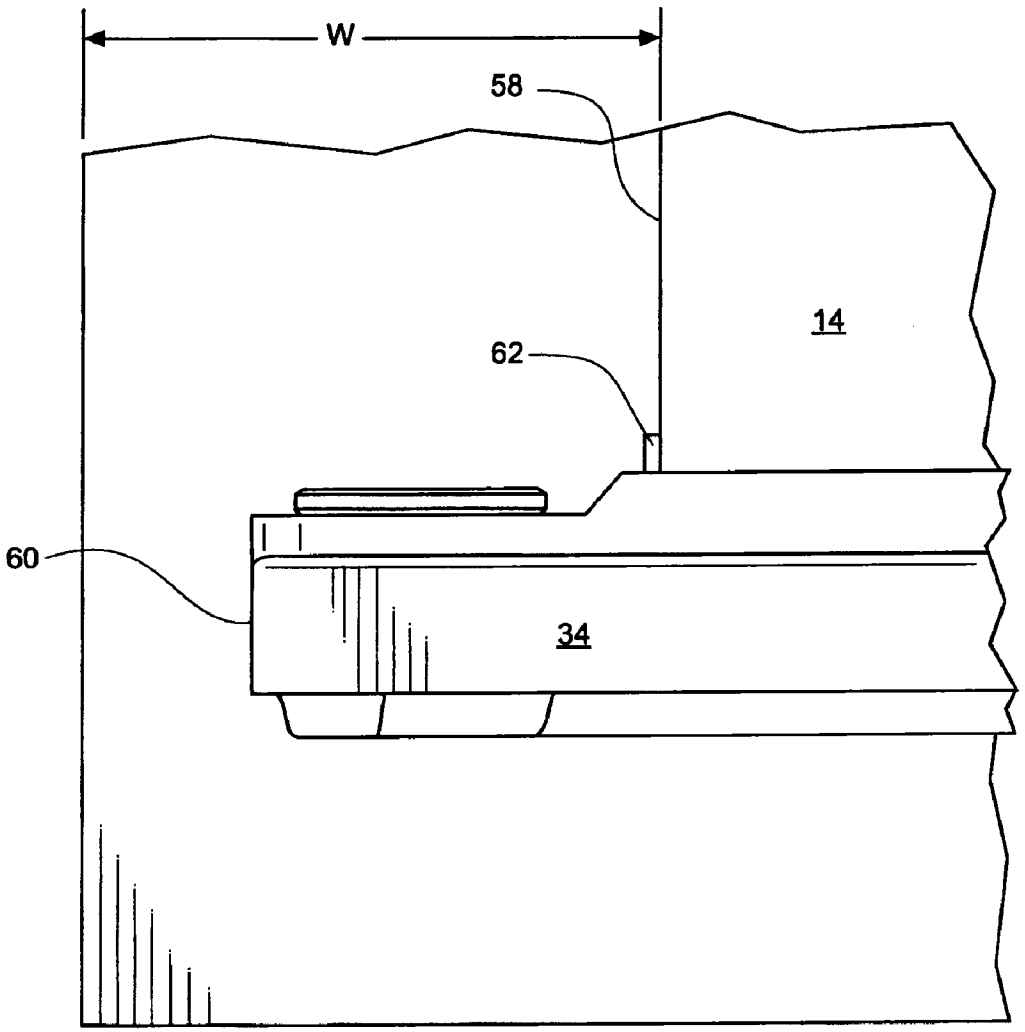
FIG. 5 is an elevation view of an alternative embodiment of the invention.

In embodiments of the invention, post 46 may be an integral extension of pivot 44 or may be a separately attached component. In alternative embodiments, a projection on either sash arm 20 or shoe 34, integrally formed or attached thereto as a separate component, may substitute for post 46. For example, as depicted in FIG. 5, an integrally formed projection 62 may be provided on sash arm 20. Sash 14 may be butted against projection 62 and fastened using self-drilling fasteners as before.

Figure 6:
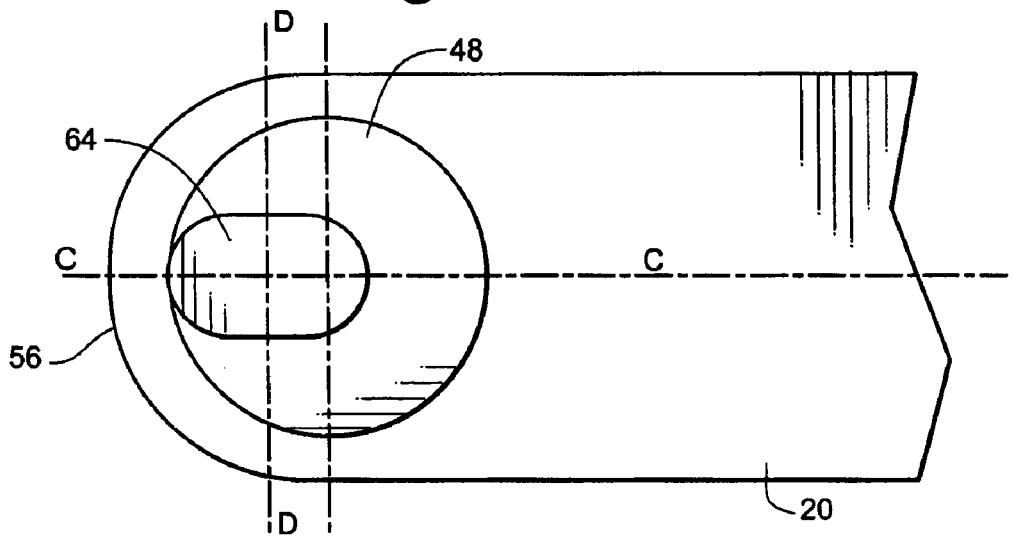
FIG. 6 is a top plan view of the sash arm pivot and sash locator portion of an alternative embodiment.
Figure 7:
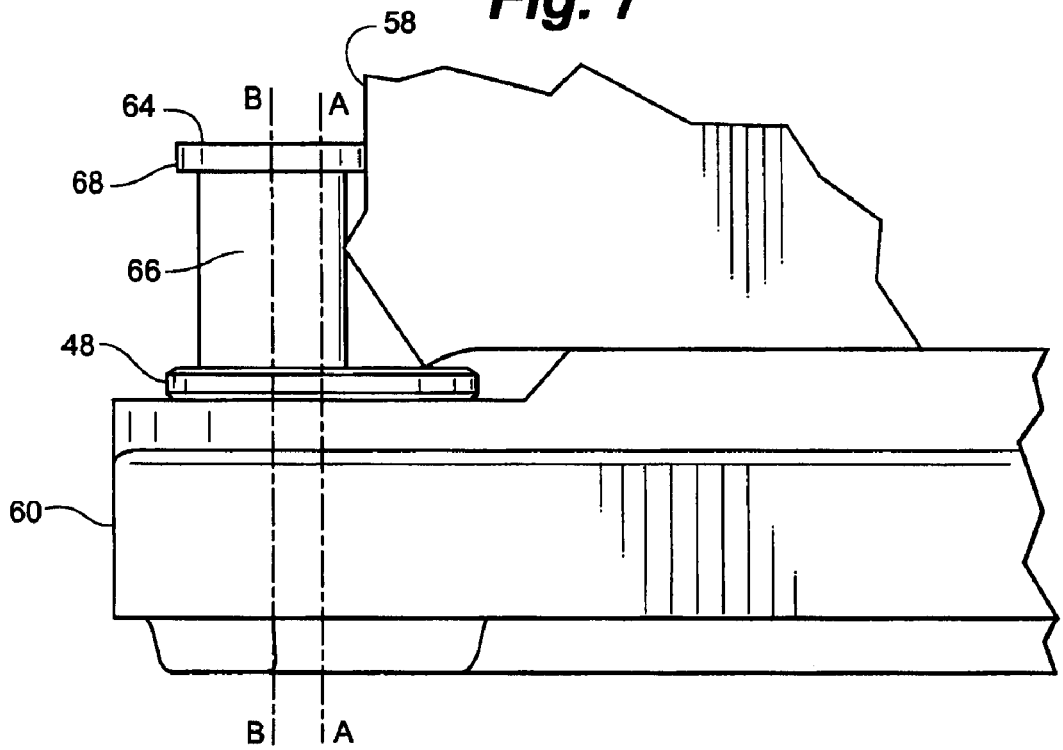
FIG. 7 is an elevation view of the embodiment of FIG. 6.

In other alternative embodiments of the invention, a selectively rotatable eccentric post or projection may be employed to provide selectively adjustable positioning. In one such embodiment depicted in FIGS. 6 and 7, eccentric sash locating post 64 has an ovoid cylindrical barrel portion 66 and a conformingly shaped enlarged head portion 68. Sash arm 20 is pivotally attached to shoe 34 about pivot axis A-A. Post 64 is coupled to base 48 and is selectively rotatable about axis B-B. For a desired spacing of inward side 58 of sash 14 that is relatively further from proximal end 60 of sash arm 20, post 64 is rotated so that major axis C-C is aligned with the longitudinal axis of sash arm 20 as depicted. If relatively closer spacing of inward side 58 from proximal end 60 is desired, post 64 may be rotated so that minor axis D-D is aligned with the longitudinal axis of sash arm 20.

Figure 8:
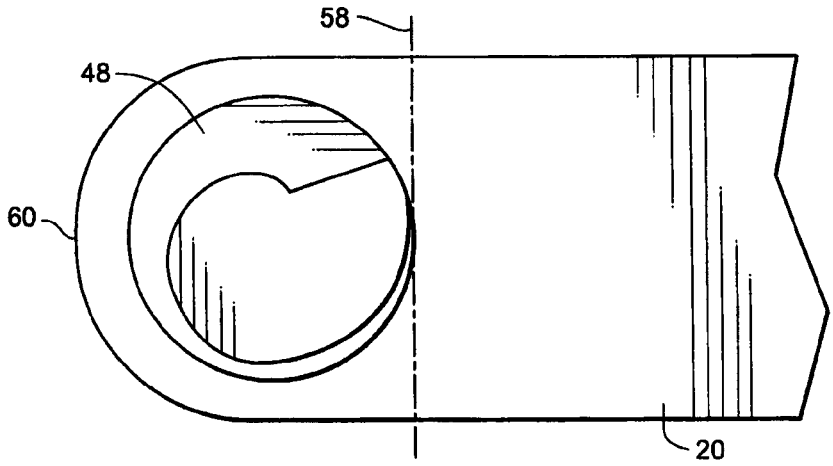
FIG. 8 is a top plan view of the sash arm pivot and sash locator portion of another alternative embodiment.
Figure 9:
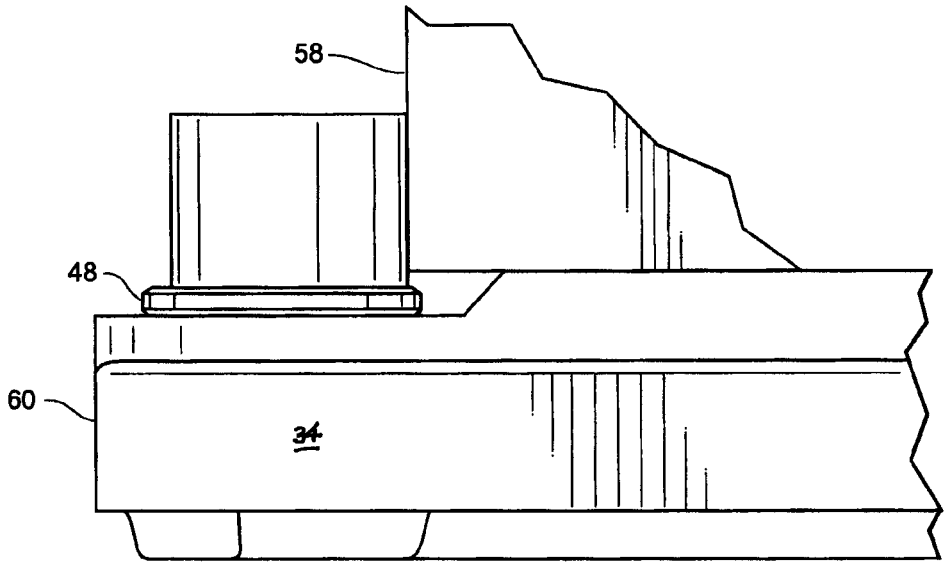
FIG. 9 is an elevation view of the embodiment of FIG. 8.

Other embodiments with sash locators providing variably adjustable sash positioning are also contemplated within the scope of the present invention. One such embodiment, for example, is depicted in FIGS. 8 and 9, and includes a selectively rotatable spiral locating post or projection. Further adjustable embodiments may include rotatable locating posts or projection with a concentric or eccentrically mounted geometrically shaped head such as a hexagonal head.

In a method according to the invention, a sash arm having a locator post or projection according to the invention is fitted on a corner of the sash so that the sash corner is butted against the locator post or projection and the longitudinal axis of the sash arm is aligned on the sash. Self drilling fasteners may then be driven through apertures in the sash arm to secure the sash arm to the sash. In adjustable embodiments of the invention, the locator post may be adjustable to provide a desired spacing of the inward side of the sash from the proximal end of the sash arm prior to the step of fitting the sash arm on the sash.

What is claimed is:

1. A sash locator for locating a casement window sash relative to a sash arm of a casement window hinge, comprising:

abutment means disposed on the sash arm such that positioning the sash proximate the sash arm with a selected portion of the sash abutting the abutment means disposes the sash relative to the sash arm in a desired disposition for affixing the sash to the sash arm, wherein the abutment means include an eccentric projection selectively rotatable relative to the sash arm.

2. A hinge assembly for a casement, the casement including a sash, the hinge assembly comprising:

a track assembly;

a sash arm operably pivotally coupled to the track assembly, the sash arm presenting a generally planar upper surface for receiving the sash thereon;

a link arm operably pivotally coupled to the track assembly and to the sash arm; and an abutment structure projecting upwardly above the upper surface of the sash arm and disposed at a selected disposition relative to the sash arm such that positioning the sash on the upper surface of the sash arm with a selected portion of the sash abutting the abutment structure disposes the sash relative to the sash arm in a desired disposition for affixing the sash to the sash arm.

3. The hinge assembly of claim 2 wherein the abutment structure is disposed in a fixed disposition relative to the sash arm.

4. The hinge assembly of claim 3 wherein the abutment structure is formed integral with the sash arm.

5. The hinge assembly of claim 2, wherein the track assembly includes a rail and a shoe slidably disposed on the rail, wherein the sash arm is coupled to the shoe of the track assembly with a pivot, and wherein the abutment structure is formed integral with the pivot.

6. The hinge assembly of claim 2 wherein the abutment structure is selectively rotatable relative to the sash arm.

7. The hinge assembly of claim 2 wherein the abutment structure has an eccentric portion and is selectively rotatable relative to the sash arm.

8. A method of locating a sash arm of a casement window hinge on a sash, comprising:

forming abutment means with an eccentric portion; and disposing the abutment means at a selected disposition on and selectively rotatable relative to the sash arm, and positioning the sash on the sash arm with a selected portion of the sash abutting the abutment means, thereby disposing the sash relative to the sash arm in a desired disposition for affixing the sash to the sash arm.

9. The method of claim 8 including disposing the abutment means in a fixed disposition relative to a longitudinal dimension of the sash arm.

* * * * *